US008389462B2

(12) United States Patent
Janszen et al.

(10) Patent No.: US 8,389,462 B2
(45) Date of Patent: Mar. 5, 2013

(54) FABRIC SOFTENING COMPOSITIONS

(75) Inventors: Jerome Anthony Janszen, Cincinnati, OH (US); George Kavin Morgan, III, Hamilton, OH (US); Kristen Taylor Hutson, Cleves, OH (US); Zaiyou Liu, West Chester, OH (US); Victoria Majerczak Tavares, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 225 days.

(21) Appl. No.: 13/015,817

(22) Filed: Jan. 28, 2011

(65) Prior Publication Data

US 2012/0192361 A1 Aug. 2, 2012

(30) Foreign Application Priority Data

Feb. 1, 2010 (CA) ..... 2689925

(51) Int. Cl.
*C11D 3/50* (2006.01)

(52) U.S. Cl. ..... 510/438; 510/441

(58) Field of Classification Search ..... 510/438, 510/441

See application file for complete search history.

(56) References Cited

U.S. PATENT DOCUMENTS

| | | | |
|---|---|---|---|
| 4,081,384 | A | 3/1978 | Pracht |
| 4,234,627 | A | 11/1980 | Schilling |
| 4,514,461 | A | 4/1985 | Woo |
| RE32,713 | E | 7/1988 | Woo |
| 4,767,547 | A | 8/1988 | Straathof et al. |
| 4,882,220 | A | 11/1989 | Ono et al. |
| 4,917,920 | A | 4/1990 | Ono et al. |
| 5,137,646 | A | 8/1992 | Schmidt et al. |
| 5,145,842 | A | 9/1992 | Driedger et al. |
| 5,460,736 | A | 10/1995 | Trinh et al. |
| 5,474,690 | A | 12/1995 | Wahl et al. |
| 5,545,340 | A | 8/1996 | Wahl et al. |
| 5,545,350 | A | 8/1996 | Baker et al. |
| 5,562,849 | A | 10/1996 | Wahl et al. |
| 6,200,949 | B1 | 3/2001 | Reijmer et al. |
| 6,645,479 | B1 | 11/2003 | Shefer et al. |
| 6,869,923 | B1 | 3/2005 | Cunningham et al. |
| 7,119,057 | B2 | 10/2006 | Popplewell et al. |
| 7,135,451 | B2 | 11/2006 | Corona, III et al. |
| 7,524,809 | B2 | 4/2009 | Trinh et al. |
| 7,625,857 | B2 | 12/2009 | Ward et al. |
| 2003/0060390 | A1 | 3/2003 | Demeyere et al. |
| 2003/0126282 | A1 | 7/2003 | Sarkar et al. |
| 2003/0158344 | A1 | 8/2003 | Rodriques et al. |
| 2003/0165692 | A1 | 9/2003 | Koch et al. |
| 2003/0195133 | A1 | 10/2003 | Shefer et al. |
| 2003/0203829 | A1 | 10/2003 | Shefer et al. |
| 2003/0215417 | A1 | 11/2003 | Uchiyama et al. |
| 2003/0216488 | A1 | 11/2003 | Uchiyama et al. |
| 2004/0071742 | A1 | 4/2004 | Popplewell et al. |
| 2004/0071746 | A1 | 4/2004 | Popplewell et al. |
| 2004/0072719 | A1 | 4/2004 | Bennett et al. |
| 2004/0072720 | A1 | 4/2004 | Brain et al. |
| 2004/0087477 | A1 | 5/2004 | Ness |
| 2004/0106536 | A1 | 6/2004 | Mane et al. |
| 2004/0204337 | A1 | 10/2004 | Corona et al. |
| 2005/0192207 | A1 | 9/2005 | Morgan, III et al. |
| 2008/0305982 | A1 | 12/2008 | Smets et al. |
| 2009/0005280 | A1 * | 1/2009 | Woo et al. ..... 510/102 |
| 2009/0247449 | A1 | 10/2009 | Burdis et al. |
| 2011/0086788 | A1 * | 4/2011 | Smets et al. ..... 510/105 |

FOREIGN PATENT DOCUMENTS

| | | | |
|---|---|---|---|
| EP | 1 393 706 | A1 | 3/2004 |
| WO | WO 99/55819 | A1 | 11/1999 |

OTHER PUBLICATIONS

International Search Report, International Application No. PCT/US2011/023163, mailed May 23, 2011, 10 pages.

Stanton, David T. et al., Computer-Assisted Prediction of Normal Boiling Points of Pyrans and Pyrroles, J. Chem. Inf. Comput. Sci., 1992, pp. 306-316, vol. 32.

Stanton, David T. et al., Computer-Assisted Prediction of Normal Boiling Points of Furans, Tetrahydrofurans, and Thiophenes, J. Chem. Inf. Comput. Sci., 1991, pp. 301-310, vol. 31.

ClogP User Guide, ClogP Manual, Version 4.0, BioByte Corp., 1999.

ClogP Reference Manual, Daylight Version 4.9, Release date Feb. 1, 2008, http://www.daylight.com/dayhtml/doc/clogp/index.html.

Murugan, Ramiah et al., Predicting Physical Properties from Molecular Structure, Chemtech, Jun. 1994, pp. 17-23.

Gordon, Arnold J. et al., Properties of Molecular Systems, The Chemist's Companion, A Handbook of Practical Data, Techniques, and References, A. Wiley-Interscience Publication, John Wiley & Sons, New York Chichester Brisbane Toronto, 1972, pp. 30-36.

* cited by examiner

*Primary Examiner* — John Hardee

(74) *Attorney, Agent, or Firm* — James F. McBride; Melissa G. Krasovec; Steven W. Miller

(57) ABSTRACT

Fabric softening compositions comprising two specific encapsulated perfume compositions provide an improved laundry experience to consumers.

20 Claims, No Drawings

FABRIC SOFTENING COMPOSITIONS

FIELD OF THE INVENTION

The present invention relates to fabric softeners having perfume.

BACKGROUND OF THE INVENTION

Scent associated with laundered laundry is important to many consumers. There are many so called "touch points" with consumers associated during the laundry experience. Non-limiting examples of these touch points include the freshness experience associated with opening a fabric care container, opening a washing machine after washing laundry, opening a laundry dryer after drying laundry, and freshness associated with wearing laundered clothes. If a laundry product delights the consumer during these touch points, it should make what many consider a laborious chore to a more delightful experience. There is a need to delight consumers at all the laundry touch points. There is also a need to delight the consumers whilst keeping the "signature character" of the product.

SUMMARY OF THE INVENTION

The present invention attempts to meet one or more of these needs. Without wishing to be bound by theory, a desirable fabric odor that remains, or is at least available, on treated fabric for about the one day after having laundered laundry is important to a consumer's laundry experience. Applicant's unpublished consumer research suggests that there is a significant portion of USA consumers that will fold and put away their laundry about one day after having laundered laundry. Freshness while folding laundry about one day after having laundered laundry also signals to the consumer that the laundry is clean.

DOWNY is a popular brand fabric softener composition manufactured by Applicant (i.e., The Procter & Gamble Company). It is a so called "rinse added" product that is dosed to a laundry washing machine (e.g., via specific designated fabric softening compartment or a dosing device such as the DOWNY Ball) so that that machine administers the composition during a rinse cycle of the laundry cycle. "APRIL FRESH" is a popular scent variant of DOWNY. We have recently observed that at least one consumer touch point that DOWNY may be improve the freshness experience to consumers vis-à-vis a competitive product is a called "scent after 24 hours" (i.e., one day after having launder laundry). We are able to improve the consumer's experience using DOWNY at this touch point while still maintaining the "APRIL FRESH" signature character of the product.

A first aspect of the invention provides for a fabric softener product having a composition comprising a fabric softening active. The composition also comprises a first perfume microcapsule encapsulating a first encapsulate perfume composition, wherein the first encapsulate perfume composition comprises from 76% to 96% of perfume ingredients, by weight of the first perfume composition, having a boiling point (at standard pressure) greater than about 250° C. and a Log P greater than 2.5. The composition also comprises a second perfume microcapsule encapsulating a second encapsulate perfume composition, wherein the second perfume composition comprises from 43% to 63% of perfume ingredients, by weight of the second perfume composition, having a boiling point (at standard pressure) greater than about 250° C. and a Log P greater than 2.5. The weight ratio of the first encapsulate perfume composition to the second encapsulate perfume composition is from 50:50 to 70:30, respectively.

Another aspect of the invention provides for an article wherein the article contains a liquid fabric softening composition of the present invention.

Yet another aspect of the invention provides for a method of treating fabric comprising the step of dosing a composition of the present invention to a laundry washing machine. Kits are also included.

DETAILED DESCRIPTION OF THE INVENTION

We have surprising discovered that the use of two specific different encapsulate perfume compositions (within a perfume microcapsule) at defined ratios, delight consumers at the "scent after 24 hours" consumer touch point—while stilling maintaining the APRIL FRESH signature character of laundry treated with the fabric softener composition. The term "scent after 24 hours" means the scent consumers experience one day after laundering fabrics.

Perfume ingredients of a perfume composition may be divided into four quadrants. These quadrants are defined by a perfume ingredient's: (a) boiling point measured at standard pressure; and (b) common logarithm of estimated octanol-water partition coefficient ("Log P").

Table 1 below describes two non-limiting examples of these specific encapsulate perfume compositions. "EPC-1" is a proprietary combination of perfume ingredients that is responsible for imparting the signature APRIL FRESH scent at a number of touch points. "EPC-2" is a proprietary combination of perfume ingredients that is responsible for imparting a freshness scent at out of dryer, while folding, and/or after 24 hours touch points. EPC-1 contains a large percentage of so called "quadrant 4" perfume ingredients. EPC-2 also contains a majority of quadrant 4 perfume ingredients but most notably contains a significant percentage of "quadrant 3" ingredients.

Notably, quadrant 4 perfume ingredients are important for imparting signature characters because they are generally substantive on dry fabric. Quadrant 3 perfume ingredients, given their relatively low boiling point and hydrophobic nature, tend to partition out of water into air and generally provide scent bloom in the air.

The B.P. of many perfume ingredients are given in, e.g., "Perfume and Flavor Chemicals (Aroma Chemicals)," S. Arctander, published by the author, 1969. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually at a pressure lower than the standard pressure (760 mm Hg), the boiling point at standard pressure can be approximately estimated by using boiling point-pressure nomographs, such as those given in "The Chemist's Companion," A. J. Gordon and R. A. Ford, John Wiley & Sons Publishers, 1972, pp. 30-36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306-316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301-310, and references cited therein, and "Predicting Physical Properties from Molecular Structure," R. Murugan et al, Chemtech, June 1994, pp. 17-23.

Examples of perfume ingredients having a boiling point below 250° C. may include those described US 2005/0192207 A1, paragraph 0029. Examples of perfume ingredients having a boiling point above 250° C. may include those described in U.S. Pat. No. 7,524,809 B2, col. 5, 1, 12-32.

One way of measuring Log P of a perfume ingredient is using the "ClogP" program from BioByte Corp (e.g., ClogP Version 4.0 and Manual 1999). CLOGP USER GUIDE, Version 4.0, BioByte Corp, (1999) (http://www.biobyte.com/bb/prod/clogp40.html) is incorporated herein by reference. Another suitable way of measuring Log P is using the CLOGP program from Daylight Chemical Information Systems, Inc. of Aliso Viejo, Calif. The CLOGP Reference Manual, Daylight Version 4.9, Release Date Feb. 1, 2008 (http://www.daylight.com/dayhtml/doc/clogp/index.html), incorporated herein by reference.

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., diluting and stabilizing some other perfume ingredients. For purposes of this invention, these materials are not counted as a "perfume ingredient" as the term is used herein.

TABLE 1

Percent quadrant distribution of perfume ingredients of encapsulated perfumes

| Quadrant | Boiling Point | Log P | EPC-2 [1] | EPC-1 [2] |
|---|---|---|---|---|
| 1 | Less than 250° C. | Less than 2.5 | 6.9 | 0 |
| 2 | Greater than 250° C. | Less than 2.5 | 0 | 2 |
| 3 | Less than 250° C. | Greater than 2.5 | 40.1 | 12.2 |
| 4 | Greater than 250° C. | Greater than 2.5 | 52.8 | 85.8 |

[1] Example of a "second encapsulate perfume composition."
[2] Example of "first encapsulate perfume composition."

Turning to Table 1, "Encapsulate Perfume Composition 1 (or "EPC-1") is a proprietary composition of perfume ingredient(s) that generally provides the "APRIL FRESH" scent character to treated fabric (at least dry fabric) that is characteristic of DOWNY (APRIL FRESH scent variety). EPC-1 comprises 12.2 wt % of perfume ingredients having a boiling point less than 250° C. and a Log P greater than 2.5 (so called Quadrant 3). EPC-1 also has 85.8 wt % of perfume ingredient(s) that have a boiling point greater than 250° C. and a Log P greater than 2.5 (Quadrant 4). EPC-1 is an example of a first encapsulate perfume composition.

Encapsulate Perfume Composition 2 (or EPC-2) is a proprietary composition of perfume ingredient(s) that generally provides the scent benefits freshness scent associated at: out of dryer, while folding, and/or after 24 hours—touch points. EPC-2 comprises 40.1 wt % of perfume ingredients having a boiling point less than less than 250° C. and a Log P greater than 2.5 (Quadrant 3). EPC-2 also have 52.8% of perfume ingredient(s) that have a boiling point greater than 250° C. and a Log P greater than 2.5 (Quadrant 4). EPC-2 is an example of a second encapsulate perfume composition.

One aspect of the invention provides for a first encapsulate perfume composition (within a first perfume microcapsule) comprises from 76% to 96% (alternatively from 78% to 92%, 80% to 90%, 82% to 88%, 83% to 87%, 84% to 87%, or combination thereof), by weight of the first encapsulate perfume composition, of perfume ingredient(s) having a boiling point greater than 250° C. and a Log P greater than 2.5 (so called Quadrant 4). In one embodiment, the first encapsulate perfume composition further comprises from 5% to 25% (alternatively from 8% to 22%, 10% to 20%, 8% to 16%, 9% to 15%, 10% to 14%, 11% to 13%, or combinations thereof) by weight of the first encapsulate perfume composition, of perfume ingredient(s) having a boiling point boiling point less than 250° C. and a Log P greater than 2.5 (so called Quadrant 3). The first encapsulate perfume composition may have 1, 2, 3, 4, 5, 6, 7, 8, 9, 10 or more perfume ingredients meeting one or more of these parameters (i.e., either Quadrant 4 or 3, respectively).

One aspect of the invention provides for a second encapsulate perfume composition (within a second perfume microcapsule) comprises from 43% to 63% (alternatively from 45% to 61%, 47% to 59%, 49% to 57%, 51% to 55%, or combinations thereof), by weight of the second encapsulate perfume composition, of perfume ingredient(s) having a boiling point greater than 250° C. and a Log P greater than 2.5 (Quadrant 4). In one embodiment, the second encapsulate perfume composition further comprises from 30% to 50% (alternatively from 32% to 48%, 34% to 46%, 36% to 44%, 38% to 42%, or combinations thereof), by weight of the second encapsulate perfume composition, of perfume ingredients having a boiling point boiling point less than 250° C. and a Log P greater than 2.5 (Quadrant 3). The second encapsulate perfume composition may have 1, 2, 3, 4, 5, 6, 7, 8, 9, 10 or more perfume ingredients meeting one or more of these parameters (i.e., either Quadrant 4 or 3, respectively).

The encapsulate perfume compositions of the present invention are encapsulated in a shell to form a perfume microcapsule. The shell of the microcapsule for the respective first and second encapsulated perfume compositions may be the same or different. Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; US 2008-0305982 A1; US 2009-0247449 A1; U.S. Pat. Nos. 6,645,479; 6,200,949; 5,145,842; 4,882,220; 4,917,920; 4,514,461; 4,234,627; 4,081,384; US RE 32713; U.S. Pat. Nos. 4,234,627; 7,119,057. In another embodiment, the perfume microcapsule comprises a friable microcapsule. In another embodiment, the shell comprising an aminoplast copolymer, esp. melamine-formaldehyde or urea-formaldehyde or cross-linked melamine formaldehyde or the like. Capsules may be obtained from Appleton Papers Inc., of Appleton, Wis. USA.

We surprisingly observe that the weight percentage ratio of the first encapsulate perfume composition compared to the second encapsulate perfume composition provides the consumer a "winning" balance between freshness benefits at one more of the touch points scent at out of dryer, while folding, and/or after 24 hours touch points—yet still provide the APRIL FRESH character to treated fabric. Briefly, too much of the EPC-2 (as compared to the EPC-1), there is not enough consumer delight at the respective touch points. However, too much EPC-1 (as compared to the EPC-2), the consumer does not experience enough of the APRIL FRESH character.

One aspect of the invention provides for a weight percent ratio of the perfume ingredients comprising the first encapsulate perfume composition compared to those perfume ingredients comprising the second encapsulate perfume in the fabric softening composition. This weight percent ratio is from 50% to 70% (alternatively from 52% to 68%, 55% to 65%, 57% to 63%, 58% to 62%, or combinations thereof) of first encapsulate perfume composition and is from 30 to 50% (alternatively from 32% to 48%, 34% to 46%, 36% to 44%, 38% to 42%, or combinations thereof) of the second encapsulate perfume, respectively.

One aspect of the invention provides a weight ratio between the first encapsulate perfume composition and the second perfume encapsulate perfume composition is from 50:50 to 70:30, alternatively 55:45 to 65:35, respectively.

Consumer Panel Data

To screen various liquid fabric softener prototypes, two different panels of twenty women (n=20) who currently use liquid fabric softener are used. Of each panel of twenty, half of the panelists (i.e., 10) are recruited to be users of DOWNY APRIL FRESH, while the other half are recruited to be users of any other brand (non-DOWNY). This way, we measure acceptance among current loyal DOWNY users, as well as measure potential among non-DOWNY users (i.e., competitive products).

The results of four prototypes (compared to a major competitor product) are discussed in Tables 2a and 2b. Prototypes 1 and 2 are tested with a first group of 20 panelists as part of a screening phase to identify lead candidates. Prototype 3 and 4 are tested with another second group of 20 panelists who are recruited as we began the next phase of the work. The testing design, recruitment etc. are the same for each of the two groups.

Each week, these panelists receive two products to use at home over the course of that week. One of the two products is a prototype product, while the other is a commercially available major competitor product (i.e., non-DOWNY product). It is the competitive product is that serves as the benchmark for the prototype product. At the end of the week, the panelists complete a questionnaire about their experience with respect to the two products. The questionnaire includes questions about the overall experience, as well as the scent experience at each touch point. The scale is from 1 to 100 where 1 is the least desirable while 100 is the most desirable. Scent intensity is also assessed from a scale of −2 to +2. With regard to scent intensity, the panelist is asked "Thinking just about the amount of scent of the Fabric Softener, how would you describe the amount of scent or odor in each of the following areas". The scent intensity scale is as follows: A lot more than I like (=+2); A little more than I like (=+1); Just right (=0); A little less than I like (=−1); Much less than I like (=−2).

The average of the 20 panelists is reported. Table 2a tabulates data for prototypes 1 and 2. Table 2b tabulates data for prototypes 3 and 4.

Notable touch points assessed include "scent on dried fabric after 24 hrs, and "amount of scent after twenty-four hours." With out wishing to be bound by theory, internal P&G consumer data suggests that many consumers fold laundry about one day after having laundered laundry. As such, improving these touch points are likely important in delighting the consumer's overall laundry experience with fabric softener product.

Tables 2a and 2b provides comparative data of prototypes against that of commercially available major competitor product.

TABLE 2a

Comparative Data of prototypes versus Competitive Product

| (n = 20) | Competitive Brand (Avg) | Prototype 1: Neat Perfume Alpha + 0.33 EPC-1/ 0.22 EPC-2 * | Δ | Prototype 2: Neat Perfume Alpha + 0.22 EPC-1/ 0.33 EPC-2 † | Δ |
|---|---|---|---|---|---|
| Overall Preference (as compared competitive brand product) | | 66% | | 40% | |
| Ratings: (1 to 100 scale) | | | | | |
| Overall Rating: | 67 | 62 | −5 | 62 | −5 |
| Scent of product | 62 | 60 | −2 | 58 | −4 |
| Scent on wet fabrics | 62 | 68 | +6 | 65 | +3 |
| Scent in the room | 61 | 66 | +5 | 60 | +1 |
| Scent out of the dryer | 51 | 59 | +8 | 50 | −1 |
| Scent on dried fabrics after 24 hrs | 57 | 69 | +12 | 50 | −7 |
| Intensity: (−2 to +2 scale) | | | | | |
| Amount of scent on wet | −1 | 0 | | −1 | |
| Amount of scent in room | −1 | 0 | | −1 | |
| Amount of scent after 24 hrs. | −1 | −1 | | −1.5 | |

* Weight ratio is 66 EPC-1:44 EPC-2

† Weight ratio is 44 EPC-1:66 EPC-2

TABLE 2b

Comparative Data of prototypes versus Competitive product

| (n = 20) | Competitive Brand (Avg) | Prototype 3: 1.75 Neat Perfume Beta + 0.33 EPC-1/ 0.22 EPC-2 * | Δ | Prototype 4: 1.75 Neat Perfume Beta + 0.22 EPC-1/ 0.33 EPC-2 † | Δ |
|---|---|---|---|---|---|
| Overall Preference (as compared competitive brand product) | | 67% | | 67% | |

TABLE 2b-continued

| Comparative Data of prototypes versus Competitive product | | | | | |
|---|---|---|---|---|---|
| | | Prototype 3 | | Prototype 4 | |
| (n = 20) | Competitive Brand (Avg) | 1.75 Neat Perfume Beta + 0.33 EPC-1/ 0.22 EPC-2 * | Δ | 1.75 Neat Perfume Beta + 0.22 EPC-1/ 0.33 EPC-2 † | Δ |
| Ratings: (1 to 100 scale) | | | | | |
| Overall Rating | 53 | 71 | +18 | 42 | −9 |
| Scent of product | 58 | 73 | +15 | 54 | −4 |
| Scent on wet fabrics | 54 | 62 | +8 | 59 | +5 |
| Scent in the room | 40 | 48 | +8 | 46 | +6 |
| Scent out of the dryer | 38 | 65 | +27 | 54 | +16 |
| Scent on dried fabrics after 24 hrs | 39 | 68 | +29 | 58 | +19 |
| Intensity: (−2 to +2 scale) | | | | | |
| Amount of scent on wet | −1 | −0.5 | | 0 | |
| Amount of scent in room | −1 | −0.5 | | −0.5 | |
| Amount of scent after 24 hrs. | −2 | −1 | | −0.5 | |

* Weight ratio is 66 EPC-1:44 EPC-2
† Weight ratio is 44 EPC-1:66 EPC-2

Prototype 1 is a formulation within the scope of the present invention whereas as prototype 2 is out the scope of the present invention. Although both prototypes 1 and 2 use the same first and second encapsulate perfume compositions, namely EPC-1 and EPC-2 respectively, the weight ratios are different. Prototype 1 has a weight ratio of 66 EPC-1 to 44 EPC-2. Prototype 2 is the inverse, i.e., a weight ratio of 44 EPC-1 to 66 EPC-2. Notably, prototype 1 is preferred by panelists at the "scent on dried fabrics after 24 hrs" touch point. Prototype 1 scored 12 points higher than competitive product whereas prototype 2 scored a negative 7 points against the competitive product. Prototypes 1 and 2 contain the same free perfume (a proprietary composition referred to as Neat Perfume Alpha).

Prototypes 3 and 4 also varied the EPC-1 and EPC-2 ratios but used the same free perfume (but different from the free perfume of prototypes 1 and 2). The free perfume of prototypes 3 and 4 is a proprietary composition referred to as Net Perfume Beta. Prototypes 3 and 4 contain this same free perfume. Again, prototype 3 that has the desirable weight ratio of 66 EPC-1 to 44 EPC-2 (within the scope of the invention) that is preferred by panelists at the "scent on dried fabrics after 24 hrs" touch point—compared to the competitive product and prototype 4. Prototype 4, like prototype 2, had a weight ratio of 44 EPC-1 to 66 EPC-2 (outside the scope of the invention).

One aspect of the invention provides a weight ratio between the first encapsulate perfume composition and the second encapsulate perfume composition is from 50:50 to 70:30, alternatively 55:45 to 65:35, alternatively combinations thereof, respectively.

Fabric Softener Active

Liquid fabric softening compositions (such as those contained in DOWNY) comprise a fabric softening active. One class of fabric softener actives includes cationic surfactants. Examples of cationic surfactants include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. A final fabric softening composition (suitable for retail sale) will comprise from about 1% to about 30%, alternatively from about 10% to about 25%, alternatively from about 15 to about 20%, alternatively from about 1% to about 5%, alternatively combinations thereof, of fabric softening active by weight of the final composition. Fabric softening compositions, and components thereof, are generally described in US 2004/0204337. In one embodiment, the fabric softening composition is a so called rinse added composition. In such embodiment, the composition is substantially free of detersive surfactants, alternatively substantially free of anionic surfactants. In another embodiment, the pH of the fabric softening composition is acidic, for example between pH 2 and 4. In yet another embodiment, the fabric softening active is DEEDMAC (e.g., ditallowoyl ethanolester dimethyl ammonium chloride). DEEDMAC means mono and di-fatty acid ethanol ester dimethyl ammonium quaternaries, the reaction products of straight chain fatty acids, methyl esters and/or triglycerides (e.g., from animal and/or vegetable fats and oils such as tallow, palm oil and the like) and methyl diethanol amine to form the mono and di-ester compounds followed by quaternization with an aklyating agent. See U.S. Pat. Nos. 4,767,547; 5,460,736; 5,474,690; 5,545,340; 5,545,350; 5,562,849. A suitable supplier of fabric softening active may include Evonik Degussa Corporation. In one embodiment, the fabric softener compositions are "rinse added" compositions essentially free of detersive surfactants or detersive anionic surfactants. These fabric softeners typically have about 2% to about 20%, alternatively from about 3% to about 17%, alternatively from about 5% to about 15%, alternatively combinations thereof, of a fabric softening active by weight of the liquid composition. In one embodiment, the composition comprises from about 1% to about 3% ethanol and a pH from about 2.5 to about 4.5. In yet another embodiment, the composition is a "wash added" composition.

Adjunct Ingredients

Adjunct ingredients that may be added to the compositions of the present invention. The ingredients may include: suds suppressor, preferably a silicone suds suppressor (US 2003/0060390 A1, ¶65-77), cationic starches (U.S. Pat. Nos. 7,135,451; 7,625,857); scum dispersants (US 2003/0126282 A1, ¶89-90); perfume and perfume microcapsules (U.S. Pat. No. 5,137,646); nonionic surfactant, non-aqueous solvent, fatty acid, dye, preservatives, optical brighteners, antifoam agents, and combinations thereof.

Other adjunct ingredients may include: dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, anti-shrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, antimicrobial, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, enzymes, cationic starch, and combinations thereof. In one embodiment, the composition comprises one or more adjunct ingredient up to about 2% by weight of the composition. In yet another embodiment, the composition of the present invention may be free or essentially free of any one or more adjunct ingredients. In yet another embodiment, the composition is free or essentially free of detersive surfactants.

In one embodiment, the pH of the composition may comprise a pH of from about 2 to about 5, preferably from about 2 to about 4.5, and more preferably from about 2.5 to about 4. In another embodiment, the composition comprises a neutral pH, alternatively from about 5 to about 9, alternatively from 5.1 to about 6, alternatively from about 6 to about 8, alternatively from about 7, alternatively combinations thereof.

Methods of Softening

In one aspect of the invention, a method of softening or treating a fabric is provided. In one embodiment, the method comprises the step of obtaining a composition of the present invention. In another embodiment, the method comprises the step of administering a composition of the present invention to a rinse cycle of an automatic laundry machine or a hand washing laundry rinse basin. In yet another embodiment, the method comprises the step of administering a composition of the present invention to a wash cycle of an automatic laundry machine or a hand washing laundry wash basin. The term "administering" means causing the composition to be delivered to the respective (i.e., wash or rinse) bath solution. Non-limiting examples of administering include, for example, dispensing the composition in an automatic fabric softener dispenser that is integral to the laundry washing machine whereby the dispenser dispenses the composition at the appropriate time during the laundry washing process, e.g., last rinse cycle. Another example is dispensing the composition in a device, such a DOWNY BALL, wherein the device will dispense the composition at the appropriate time during the laundry washing process. In another embodiment, a composition of the present invention is dosed in a first rinse bath solution or a dosed in a single rinse bath solution. This is particularly convenient in a hand washing context. See e.g., U.S. Pat. Appl. No. 2003-0060390 A1. In one embodiment, a method of softening a fabric in a manual rinse processes comprising the steps: (a) adding a fabric softening composition of the present invention to a first rinse bath solution; (b) rinsing manually the fabric in the first rinse bath solution; (c) optionally the fabric softening composition comprises a suds suppressor. A method of reducing the volume of water consumed in a manual rinse process comprises the aforementioned step is also provided.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric softening composition comprising:

(a) a fabric softening active;

(b) a first perfume microcapsule encapsulating a first encapsulate perfume composition, wherein the first encapsulate perfume composition comprises from 76% to 96% of perfume ingredients, by weight of the first perfume composition, having a boiling point (at standard pressure) greater than about 250° C. and a Log P greater than 2.5;

(c) a second perfume microcapsule encapsulating a second encapsulate perfume composition, wherein the second perfume composition comprises from 43% to 63% of perfume ingredients, by weight of the second perfume composition, having a boiling point (at standard pressure) greater than about 250° C. and a Log P greater than 2.5;

(d) wherein the weight ratio of the first encapsulate perfume composition to the second encapsulate perfume composition is from 50:50 to 70:30, respectively;

(d) optionally from 1% to 3% of a free perfume comprising a third perfume composition wherein the third perfume composition is different from the both the first perfume composition and the second perfume composition.

2. The composition of claim 1, wherein the first encapsulate perfume composition further comprises from about 5% to 25% of perfume ingredients, by weight of the first perfume composition, having a boiling point less than 250° C. and a Log P greater than 2.5.

3. The composition of claim 2, wherein the second encapsulate perfume composition further comprises from 30% to 50% of perfume ingredients, by weight of the second perfume composition, having a boiling point boiling point less than 250° C. and a Log P greater than 2.5.

4. The composition of claim 1, wherein the second encapsulate perfume composition further comprises from 30% to 50% of perfume ingredients, by weight of the second perfume composition, having a boiling point boiling point less than 250° C. and a Log P greater than 2.5.

5. The composition of claim 1, wherein:

(a) the first encapsulate perfume composition further comprises:

(i) from 78% to 92% of perfume ingredient(s), by weight of the first encapsulate perfume composition, having a boiling point greater than 250° C. and a Log P greater than 2.5;

(ii) from 8% to 22% of perfume ingredient(s), by weight of the first encapsulate perfume composition, of having a boiling point boiling point less than 250° C. and a Log P greater than 2.5;

(b) the second encapsulate perfume composition further comprises:

(i) from 45% to 61% of perfume ingredient(s), by weight of the second encapsulate perfume composition, having a boiling point greater than 250° C. and a Log P greater than 2.5;

(ii) from 32% to 48% of perfume ingredient(s), by weight of the second encapsulate perfume composition, having a boiling point boiling point less than 250° C. and a Log P greater than 2.5.

6. The composition of claim 5, wherein:

(a) the first encapsulate perfume composition further comprises:

(i) from 80% to 90% of perfume ingredient(s), by weight of the first encapsulate perfume composition, having a boiling point greater than 250° C. and a Log P greater than 2.5;

(ii) from 8% to 20% of perfume ingredient(s), by weight of the first encapsulate perfume composition, of having a boiling point boiling point less than 250° C. and a Log P greater than 2.5;

(b) the second encapsulate perfume composition further comprises (i) from 47% to 59% of perfume ingredient(s), by weight of the second encapsulate perfume composition, having a boiling point greater than 250° C. and a Log P greater than 2.5;

(ii) from 34% to 46% of perfume ingredient(s), by weight of the second encapsulate perfume composition, having a boiling point boiling point less than 250° C. and a Log P greater than 2.5.

7. The composition of claim 6, wherein:

(a) the first encapsulate perfume composition further comprises:

(i) from 82% to 88% of perfume ingredient(s), by weight of the first encapsulate perfume composition, having a boiling point greater than 250° C. and a Log P greater than 2.5;

(ii) from 9% to 15% of perfume ingredient(s), by weight of the first encapsulate perfume composition, of having a boiling point boiling point less than 250° C. and a Log P greater than 2.5;

(b) the second encapsulate perfume composition further comprises:

(i) from 49% to 57% of perfume ingredient(s), by weight of the second encapsulate perfume composition, having a boiling point greater than 250° C. and a Log P greater than 2.5;

(ii) from 36% to 44% of perfume ingredient(s), by weight of the second encapsulate perfume composition, having a boiling point boiling point less than 250° C. and a Log P greater than 2.5.

8. The composition of claim 7, wherein:

(a) the first encapsulate perfume composition further comprises:

(i) from 83% to 87% of perfume ingredient(s), by weight of the first encapsulate perfume composition, having a boiling point greater than 250° C. and a Log P greater than 2.5;

(ii) from 10% to 14% of perfume ingredient(s), by weight of the first encapsulate perfume composition, of having a boiling point boiling point less than 250° C. and a Log P greater than 2.5;

(b) the second encapsulate perfume composition further comprises:

(i) from 51% to 55% of perfume ingredient(s), by weight of the second encapsulate perfume composition, having a boiling point greater than 250° C. and a Log P greater than 2.5;

(ii) from 38% to 42% of perfume ingredient(s), by weight of the second encapsulate perfume composition, having a boiling point boiling point less than 250° C. and a Log P greater than 2.5.

9. The composition of claim 8, wherein the weight ratio between the first encapsulate perfume composition and the second perfume encapsulate perfume composition is from 55:45 to 65:35, respectively.

10. The composition of claim 9, wherein the fabric softener active comprises an ester quaternary ammonium compound suitable for softening fabric.

11. The composition of claim 10, wherein the composition a rinse added composition essentially free of a detersive surfactant.

12. The composition of claim 11, wherein the composition is a liquid composition, has a pH less than 7, and has from 15% to 25% of the ester quaternary ammonium compound, by weight of the composition.

13. The composition of the claim 8, wherein the first perfume microcapsule comprises a first shell and the second perfume microcapsule comprises a second shell, wherein the first shell and the second shell are of a same composition.

14. The composition of the claim 8, wherein the first perfume microcapsule comprises a first shell and the second perfume microcapsule comprises a second shell, wherein the first shell and the second shell are of a different composition.

15. The composition of claim 7, wherein the weight ratio between the first encapsulate perfume composition and the second perfume encapsulate perfume composition is from 55:45 to 65:35, respectively.

16. The composition of claim 6, wherein the weight ratio between the first encapsulate perfume composition and the second perfume encapsulate perfume composition is from 55:45 to 65:35, respectively.

17. The composition of claim 5, wherein the weight ratio between the first encapsulate perfume composition and the second perfume encapsulate perfume composition is from 55:45 to 65:35, respectively.

18. A method of treating fabric comprising the step of administering a composition of claim 1 to a laundry washing machine.

19. The method of claim 18, wherein the composition is administered to laundry during a rinse cycle of the laundry washing machine.

20. An article of manufacture comprising a container containing: a composition of claim 1; and a releasable attached dosing cap.

* * * * *